US007422503B2

(12) United States Patent
Fujitani et al.

(10) Patent No.: US 7,422,503 B2
(45) Date of Patent: Sep. 9, 2008

(54) PLASMA DISPLAY PANEL AND METHOD OF MANUFACTURING THE SAME

(75) Inventors: Morio Fujitani, Osaka (JP); Keisuke Sumida, Osaka (JP); Tatsuo Mifune, Osaka (JP); Shinichiro Ishino, Shiga (JP); Hiroyuki Tachibana, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 499 days.

(21) Appl. No.: 10/555,002

(22) PCT Filed: May 18, 2004

(86) PCT No.: PCT/JP2004/007031

§ 371 (c)(1),
(2), (4) Date: Nov. 1, 2005

(87) PCT Pub. No.: WO2004/105074

PCT Pub. Date: Dec. 2, 2004

(65) Prior Publication Data

US 2006/0279214 A1 Dec. 14, 2006

(30) Foreign Application Priority Data

May 21, 2003 (JP) ..... 2003-143042

(51) Int. Cl.
*H01J 17/49* (2006.01)
*H01J 9/00* (2006.01)

(52) U.S. Cl. ..... 445/24; 445/25; 313/582; 313/584; 313/586

(58) Field of Classification Search ..... None
See application file for complete search history.

(56) References Cited

U.S. PATENT DOCUMENTS

| | | | | |
|---|---|---|---|---|
| 6,200,182 | B1 * | 3/2001 | Nanto et al. | 445/24 |
| 6,538,381 | B1 * | 3/2003 | Ueoka et al. | 313/582 |
| 7,116,289 | B2 * | 10/2006 | Yamada | 345/60 |
| 2001/0020924 | A1 | 9/2001 | Makino | |

FOREIGN PATENT DOCUMENTS

| | | |
|---|---|---|
| JP | 2-123635 | 5/1990 |
| JP | 7-105855 | 4/1995 |
| JP | 11-297211 | 10/1999 |
| JP | 11-306981 | 11/1999 |
| JP | 2002-297091 | 10/2002 |

* cited by examiner

*Primary Examiner*—Sikha Roy
*Assistant Examiner*—Natalie K Walford
(74) *Attorney, Agent, or Firm*—Wenderoth, Lind & Ponack, L.L.P.

(57) ABSTRACT

Disclosed here is a plasma display panel having stable addressing characteristics and a method of manufacturing a plasma display panel having such a reliable structure. According to the plasma display panel and the manufacturing method, on back plate (2) that confronts front plate (1) having scan electrodes (6) and sustain electrodes (7) thereon, data electrodes (10), first dielectric layer (17) disposed to cover the data electrodes, priming electrodes (15), and second dielectric layer (18) disposed to cover the priming electrodes are formed in the order named; at the same time, the softening temperatures of the materials forming the components disposed on the back plate are determined so as to become lower in the order named. The temperature setting protects first dielectric layer (17) from deterioration or deformation, improving dielectric voltage between data electrodes (10) and priming electrodes (15).

8 Claims, 9 Drawing Sheets

PLASMA DISPLAY PANEL AND METHOD OF MANUFACTURING THE SAME

THIS APPLICATION IS A U.S. NATIONAL PHASE APPLICATION OF PCT INTERNATIONAL APPLICATION PCT/JP2004/007031.

TECHNICAL FIELD

The present invention relates to a plasma display panel used for a wall-mount TV and a large sized monitor, and also relates to a method of manufacturing the same.

BACKGROUND ART

In a plasma display panel (hereinafter referred to as a PDP) with an alternate current (AC) discharging type, AC surface discharge PDPs have been dominating. Such a PDP has a front plate and a back plate that are made of a glass substrate. Scan electrodes and sustain electrodes, which are responsible for surface discharge, are disposed on the front plate, and data electrodes are disposed on the back plate. The two plates are oppositely disposed so that the electrodes disposed on each plate forms a grid pattern, and sealed at the peripheries with a sealing material, such as glass frit. A sealed clearance formed between the two plates is a discharge space divided into discharge cells by barrier ribs. Each cell has a phosphor layer.

In a PDP structured above, gas discharge generates ultraviolet light, by which phosphors responsible for red (R), green (G), and blue (B) are excited to generate visible light of respective colors.

In driving operation of the PDP, one field is divided into a plurality of sub-fields. Combining the sub-fields to be lit provides the PDP with gradation display. Each sub-field has a reset period, an address period, and a sustain period. To display images on the screen, voltage having a different waveform according to each period is applied to the electrodes. In the reset period, for example, positive pulse voltage is applied to all the scan electrodes to form necessary wall charges on a protective film provided over a dielectric layer covering the scan electrodes and sustain electrodes, and on the phosphor layers. In the address period, the scan electrodes undergo scanning in which negative scanning pulses are sequentially applied to all the scan electrodes. To display images on the screen, positive data pulses are applied to the data electrodes during the scanning. This causes discharge between the scan electrodes and the data electrodes, thereby forming wall charges on the surface of the protective film on the scan electrodes.

In the sustain period following the address period, a voltage adequate for sustaining discharge for a predetermined period is applied between the scan electrodes and the sustain electrodes. The application of voltage generates discharge plasma between the scan electrodes and the sustain electrodes, by which an excited phosphor layer emits light for a period. On the other hand, in the discharge space to which no data pulse is applied during the address period, no discharge occurs and accordingly, neither excitation nor light emitting of the phosphor layers.

In the PDP above, a perceptible discharge delay generated in the address period invites an unstable addressing operation. Increasing the address time so that the addressing operation is satisfactorily carried out inevitably shortens the time for the sustain period, which results in a poor luminescence.

To address the problems above, there has been a suggestion in which a PDP and a driving method capable of minimizing the discharge delay. According to the suggestion, an auxiliary discharge electrode is disposed on the front plate to generate surface auxiliary discharge spreading in a plane near by the front plate. As a result, priming discharge occurs, contributing to minimized discharge delay.

The PDP introduced in the suggestion above, however, has several problems: insufficient reduction of the discharge delay in the address period; insufficient operation margin of the auxiliary discharge; unstable operations influenced by undesired false discharge. In addition, the auxiliary discharge occurs in the surface of the front plate, and therefore an amount of priming particles larger than necessary for priming is fed to an adjacent discharge cell, which has often caused crosstalk.

DISCLOSURE OF THE INVENTION

The PDP of the present invention contains a first electrode and a second electrode disposed on a first substrate so as to be parallel with each other; a third electrode disposed on a second substrate confronting the first substrate via a discharge space so as to be orthogonal to the first electrode and the second electrode; a fourth electrode disposed on the second substrate so as to be parallel with the first and second electrodes and to be positioned closer to the first and second electrodes than the third electrode; and a barrier rib disposed on the second substrate so as to separate a plurality of main discharge cells, which are formed of the first, second, and third electrodes, from a plurality of priming discharge cells, which are formed of the first electrode and the fourth electrode or formed of the second electrode and the fourth electrode. In the aforementioned PDP, at least the third electrodes are covered with a first dielectric layer and the fourth electrodes are disposed on the first dielectric layer. In addition, the fourth electrodes are made of material having a softening temperature lower than that of material forming the first dielectric layer.

DETAILED DESCRIPTION OF CARRYING OUT OF THE INVENTION

The exemplary embodiments of the present invention are described hereinafter with reference to the accompanying drawings.

First Exemplary Embodiment

Here will be described a PDP and a manufacturing method of the first exemplary embodiment with reference to FIGS. 1 through 5. It is to be understood that the present invention is not limited to the forms described here.

Figure 1:
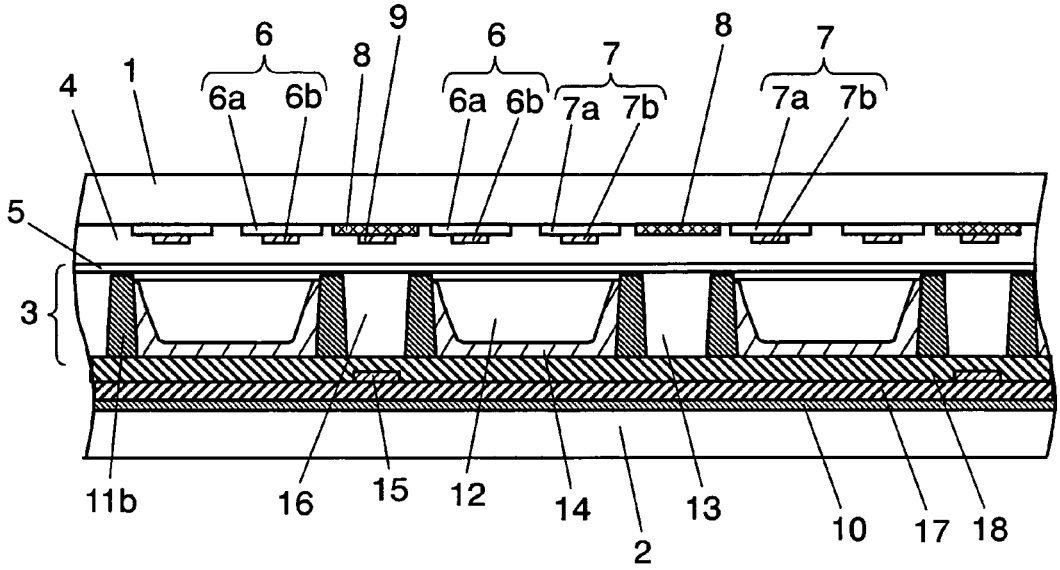
FIG. 1 is a section view illustrating a PDP of a first exemplary embodiment of the present invention.
Figure 2:
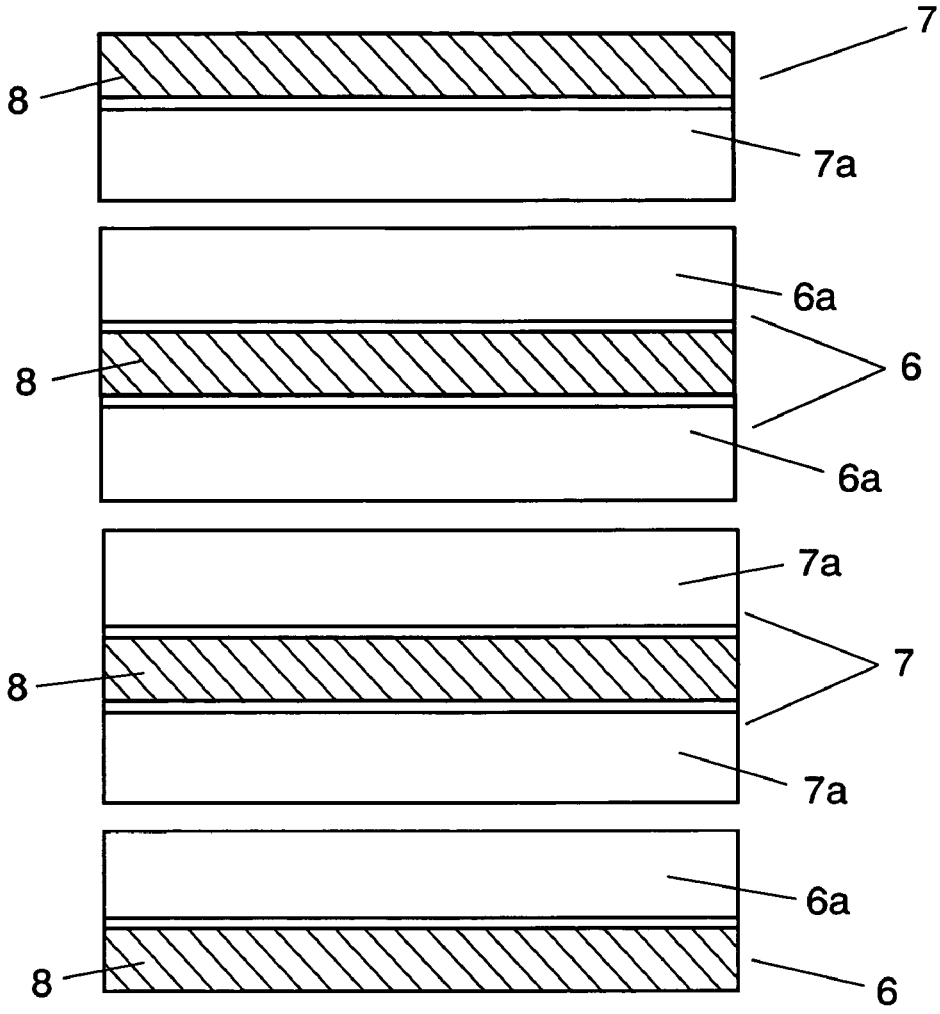
FIG. 2 is a plan view schematically showing the electrode layout on the side of the front plate of the PDP.
Figure 3:
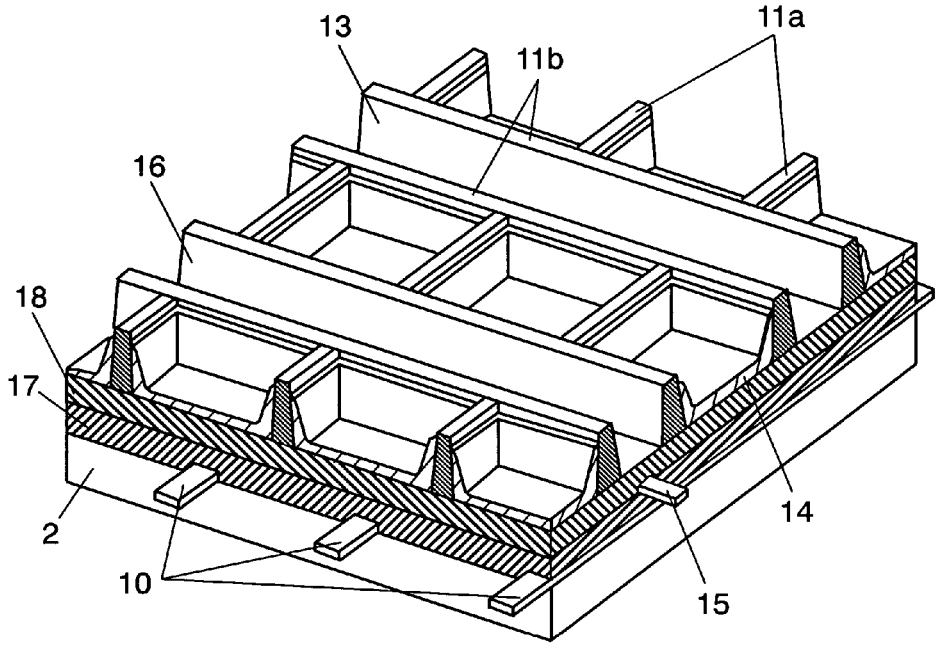
FIG. 3 is a perspective view that schematically shows the side of the back plate of the PDP.

FIG. 1 is a section view illustrating the PDP of the first exemplary embodiment of the present invention. FIG. 2 is a plan view schematically showing the electrode layout on the side of the front plate of the PDP. FIG. 3 is a perspective view that schematically shows the side of the back plate of the PDP.

As shown in FIG. 1, glass-made front plate 1 as the first substrate and glass-made back plate 2 as the second substrate are oppositely disposed via discharge space 3 therebetween. Discharge space 3 is filled with a gas, such as neon (Ne), xenon (Xe), that radiates ultraviolet light through discharging. On front plate 1, electrode array, which is formed of pairs of scan electrodes 6 (i.e., the first electrode) and sustain electrodes 7 (i.e., the second electrode) is disposed in a stripe arrangement. Each scan electrode 6 is formed of transparent electrode 6*a* and metallic bus line 6*b*; similarly, each sustain electrode 7 is formed of transparent electrode 7*a* and metallic bus line 7*b*. Bus lines 6*b* and 7*b* are made of material providing higher conductivity, such as silver (Ag), and are laid on transparent electrodes 6*a* and 7*a*, respectively. Scan electrodes 6 and sustain electrodes 7 are covered with front-plate dielectric layer 4 and over which, protective film 5 is formed. Scan electrodes 6 and sustain electrodes 7 are, as shown in FIG. 1 and FIG. 2, alternately arranged by two rows of each electrode. Between adjacent scan electrodes 6 and between adjacent sustain electrodes 7, light absorption layer 8 is disposed to intensify contrast when light is emitted. Auxiliary electrode 9 is disposed on light absorption layer 8 between adjacent scan electrodes 6 so as to connect to one of adjacent scan electrodes 6 at an end (i.e., non-display area) of the PDP.

On back plate 2, as shown in FIG. 1 and FIG. 3, a plurality of strip-shaped data electrodes 10 (as the third electrode) is disposed in parallel with each other so as to be orthogonal to scan electrodes 6 and sustain electrodes 7. First dielectric layer 17 is formed to cover data electrodes 10. Priming electrodes 15 (as the fourth electrode) are formed on first dielectric layer 17 at a section corresponding to where auxiliary electrode 9 is disposed on front plate 1 so as to be parallel to auxiliary electrode 9. Second dielectric layer 18 is laid over first dielectric layer 17 to cover priming electrodes 15. Barrier rib 11 is disposed on second dielectric layer 18. Barrier rib 11 is a divider of the discharge cells that are formed of scan electrodes 6, sustain electrodes 7, and data electrodes 10. Barrier rib 11 has vertical wall 11*a* and horizontal wall 11*b*. Vertical wall 11*a* is orthogonal to scan electrodes 6 and sustain electrodes 7 on front plate 1, or parallel to data electrodes 10. Horizontal wall 11*b* is disposed so as to cross vertical wall 11*a*. Vertical wall 11*a* and horizontal wall 11*b* form gap 13 between main discharge cells 12 and priming discharge cells 16 having priming electrode 15. That is, gap 13 and priming discharge cell 16 are alternately arranged via main discharge cell 12. Phosphor layer 12 is formed in main discharge cell 12.

As shown in FIG. 3, data electrodes 10 are covered with first dielectric layer 17 and on which, priming electrodes 15 are disposed. Further, priming electrodes 15 are covered with second dielectric layer 18. That is, compared to the distance between data electrode 10 and protective film 5 in main discharge cell 12, the distance between priming electrode 15 and protective film 5 in priming discharge cell 16 becomes shorter by the thickness of first dielectric layer 17.

Next will be described how an image data is shown on a PDP. According to the PDP in the embodiment, one field is divided into a plurality of sub-fields each of which has a weight of luminance in binary representation. Combining the sub-field to be lit provides the PDP with gradation display. Each sub-field has a reset period, an address period, and a sustain period.

Figure 4:
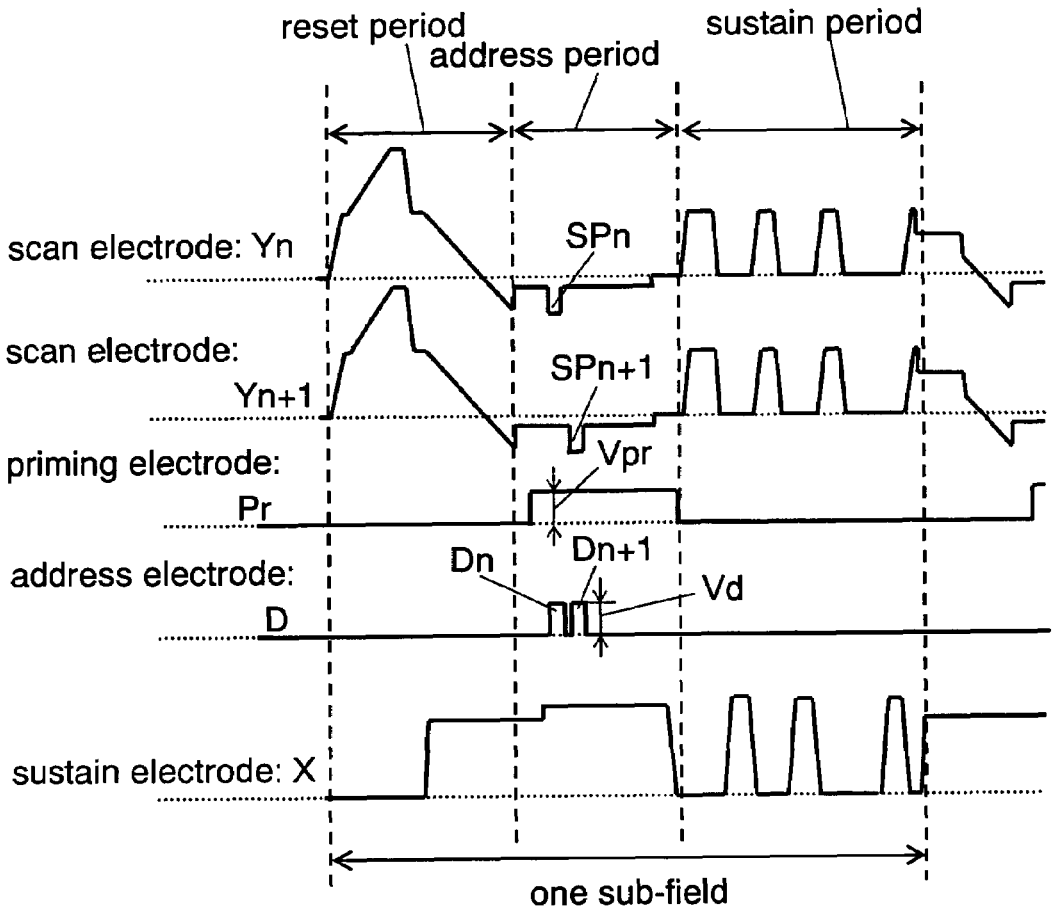
FIG. 4 shows an example of driving waveforms for driving the PDP.

FIG. 4 shows an example of driving waveforms for driving the PDP of the embodiment of the present invention. In the reset period, positive pulse voltage is applied to all scan electrode Y (corresponding to scan electrode 6 in FIG. 1) in the priming discharge cell (corresponding to priming discharge cell 16 in FIG. 1) in which priming electrode Pr (corresponding to priming electrode 15 in FIG. 1) is formed, whereby a reset operation is performed between the auxiliary electrode (corresponding to auxiliary electrode 9 in FIG. 1) and priming electrode Pr. During the address period that follows the reset period, positive voltage is applied to priming electrode Pr. In the successive sustain period, alternating voltage enough for maintaining discharge is applied between the scan electrode and the sustain electrode. The application of voltage generates discharge plasma between scan electrode Y and sustain electrode X (corresponding to sustain electrode 7 in FIG. 1) for a predetermined period, which excites the phosphor layers for light-emitting. On the other hand, the discharge cells that have no application of voltage in the address period have no discharge; accordingly, the phosphor layers in the cells have no excitation and therefore no light emitting.

In the priming discharge cell, when scan pulse SPn is applied to scan electrode Yn, priming discharge occurs between priming electrode Pr and the auxiliary electrode, providing the main discharge cell (corresponding to main discharge cell 12 in FIG. 1) with priming particles. Next, scan pulse $SP_{n+1}$ is applied to scan electrode $Y_{n+1}$ of the $n+1^{th}$ main discharge cell. At this time, the priming particles have already been fed by the priming discharge that occurred just before the application of voltage. This can minimize the delay in discharge in the next address period. Although the description here focuses on a driving sequence of a one field, operations in other sub-fields similarly work. Applying positive voltage to priming electrode Pr in the address period, as shown in the driving waveforms in FIG. 4, encourages a reliable discharge operation described above. It is preferable that the voltage applied to priming electrode Pr in the address period should be greater than that applied to data electrode D (corresponding to data electrode 10 in FIG. 1).

In the structure in which priming electrode 15 is formed on first dielectric layer 17 in priming discharge cell 16, first dielectric layer 17 can provide dielectric voltage between data electrode 10 and priming electrode 15—as long as first dielectric layer 17 is properly formed, contributing to stable priming discharge and address discharge. Besides, in priming discharge cell 16 where priming electrode 15 is formed on first dielectric layer 17, the distance between priming electrode 15 and auxiliary electrode 9 becomes shorter than that between data electrode 10 and scan electrode 6 in main discharge cell 12. The structure above allows main discharge cell 12, which corresponds to scan electrode 6 connected to auxiliary electrode 9, to have priming discharge with reliability and stability prior to the address discharge. This contributes to minimized delay in discharge in main discharge cell 12.

Figure 5:
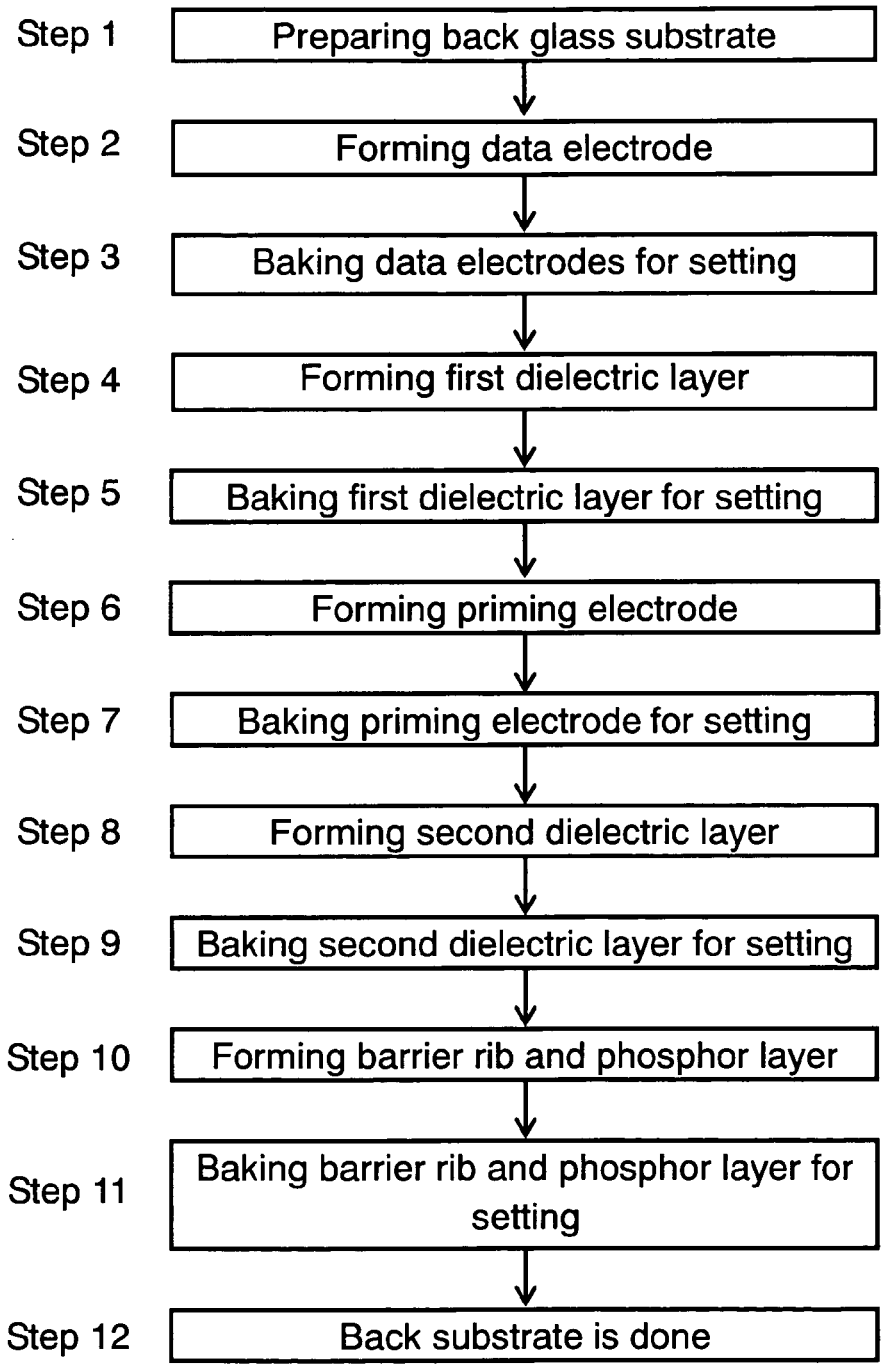
FIG. 5 is a flowchart showing the process of manufacturing the back plate of the PDP.
Figure 6:
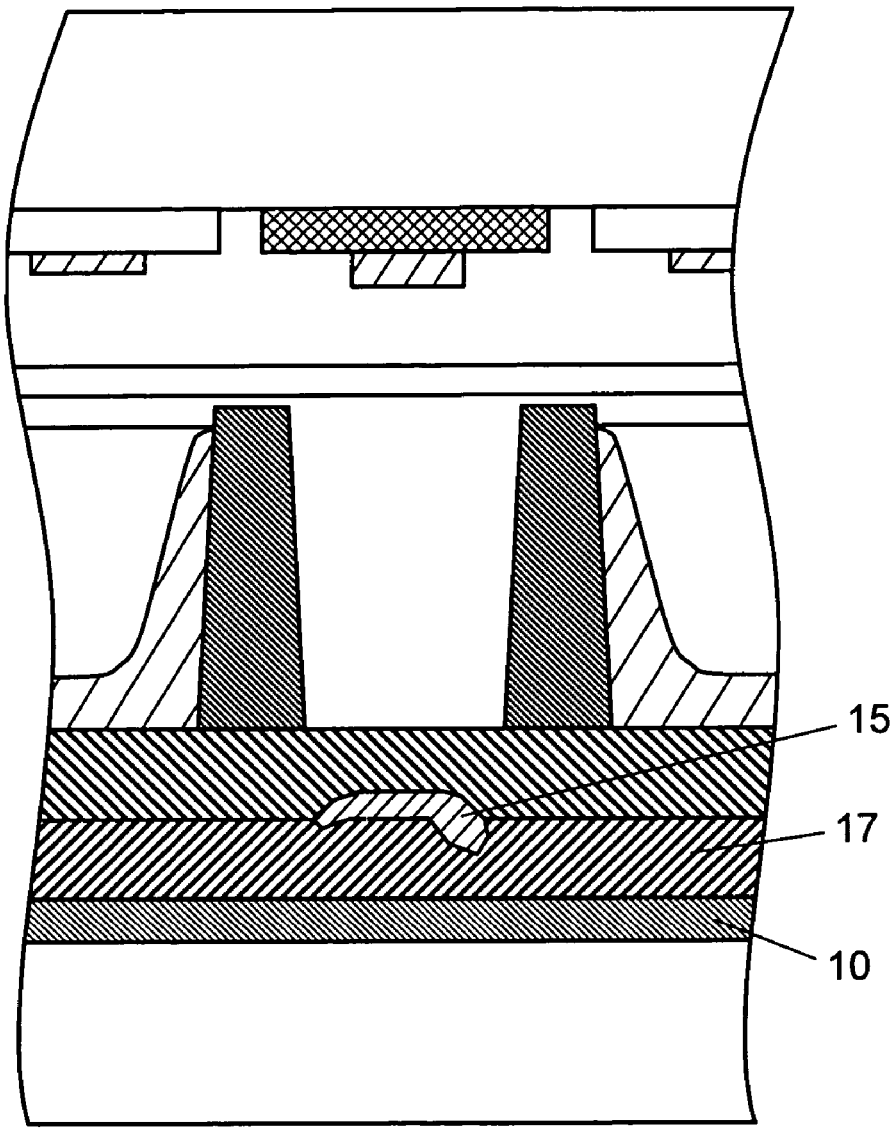
FIG. 6 (PRIOR ART)
FIG. 6 is a section view illustrating deformation observed in a conventional priming electrode.

FIG. 5 is a flowchart showing the process of manufacturing the back plate of the PDP of the embodiment.

In step 1, as shown in FIG. 5, prepare the back glass-substrate as back plate 2, and then form data electrodes 10 on the back glass-substrate in steps 2 and 3. More specifically, in step 2, apply silver (Ag) paste to the back glass-substrate and then form silver (Ag) line having a width of 150 μm by photolithography. Of the glass components forming data electrodes 10, at least one component has a softening temperature of 590° C. In step 3, harden the silver (Ag) line by baking at 600° C. to complete data electrode 10. Next, first dielectric layer 17 is formed in steps 4 and 5. As the materials of first dielectric layer 17, ZnO—$B_2O_3$—$SiO_2$-based mixture, PbO—$B_2O_3$—$SiO_2$-based mixture, PbO—$B_2O_3$—$SiO_2$—$Al_2O_3$-based mixture, PbO—ZnO—$B_2O_3$—$SiO_2$-based mixture, $Bi_2O_3$—$B_2O_3$—$SiO_2$-based mixture, or the like, can be employed. First dielectric layer 17 of the first embodiment of the present invention is a mixture of 65-70 wt % PbO; 5 wt % $B_2O_3$; and 25-30 wt % $SiO_2$, having a softening temperature of 580° C. The softening temperature can be flexibly determined by increasing or decreasing the PbO content. In step 4, mix the materials of first dielectric layer 17 into a paste and apply it over data electrode 10. The applying method is not limited to a specific one; the paste can be applied in a well know manner, such as roll coating, slit die coating, doctor blade method, screen printing, or off-set printing. In the first embodiment of the present invention, the applying thickness of the paste of first dielectric layer 17 should preferably range from 5 to 40 μm. Applying the paste with a thickness of 5 μm or more can lessen the unevenness of the surface of first dielectric layer 17—due to data electrodes 10 disposed thereunder—after the baking process. The applying thickness of first dielectric layer 17 depends on the mineral element content in the paste. In step 5, the paste is baked at 585° C. to complete first dielectric layer 17. The baking temperature of first dielectric layer 17 is lower than the softening temperature of data electrode 10, so that deterioration or deformation in data electrode 10 can be suppressed during the baking process of first dielectric layer 17.

In the next steps 6 and 7, priming electrode 15 is formed. In step 6, silver (Ag) paste is applied to first dielectric layer 17 in a manner almost the same as that for forming data electrode 10 in step 2. Of glass components forming priming electrode 15, at least one component has a softening temperature of 570° C. In step 7, the paste is baked at 575° C. to complete priming electrode 15. The baking temperature at this time (i.e., 575° C.) is lower than 580° C. that is the softening temperature of first dielectric layer 17, and is not less than 570° C. that is the softening temperature of the materials forming priming electrode 15. That is, deterioration or deformation in first dielectric layer 17 can be suppressed during the baking process of priming electrode 15.

Figure 7:
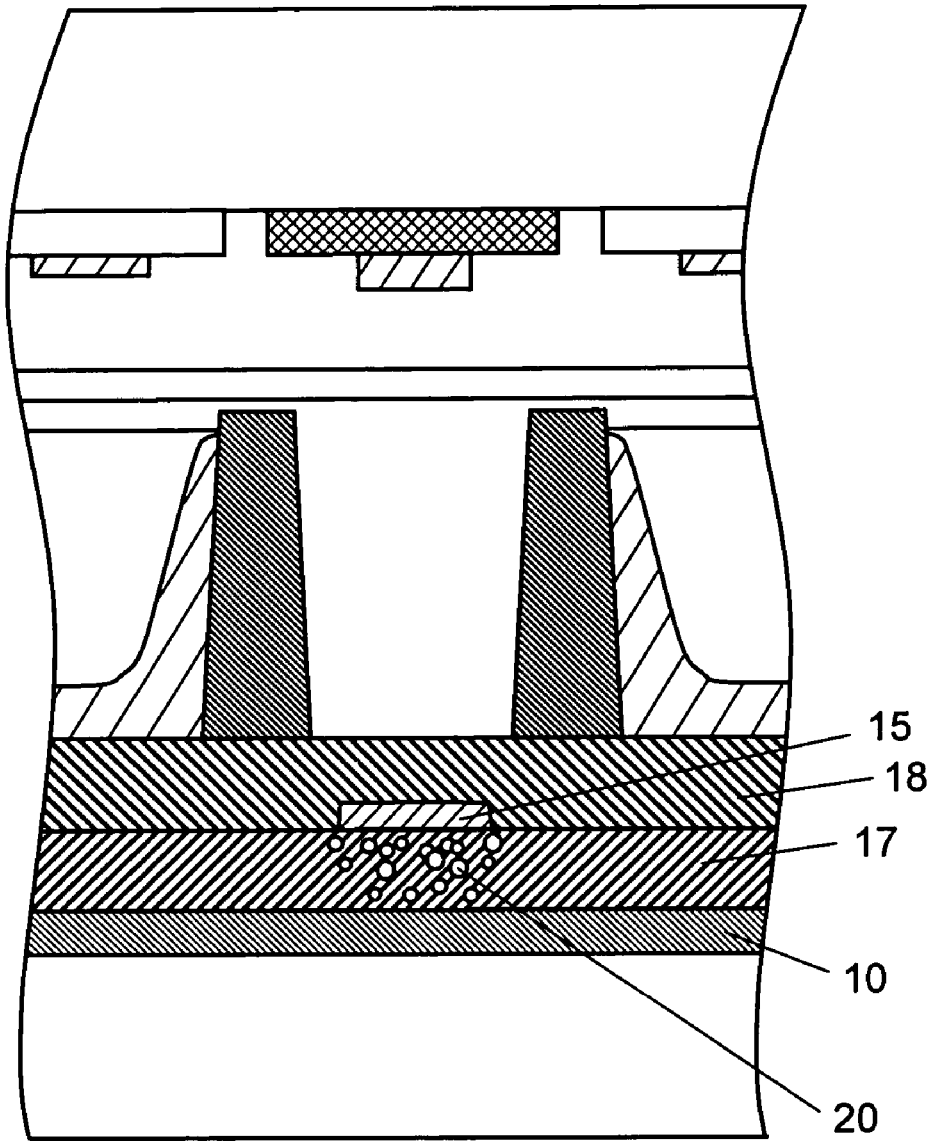
FIG. 7 (PRIOR ART)
FIG. 7 is a section view illustrating bubbles generated in a conventional first dielectric layer.

Conventionally, the softening temperature of priming electrode 15 has not always determined to be lower than that of first dielectric layer 17. Therefore, the baking temperature of priming electrode 15 has often exceeded the softening temperature of first dielectric layer 17. In this case, when priming electrode 15 undergoes the baking process, underlying first dielectric layer 17 softens, and thermally deformed priming electrode 15 sinks into softened first dielectric layer 17. As a result, priming electrode 15 and data electrode 10 cannot have a proper insulation distance therebetween. FIG. 7 is a section view illustrating bubbles generated in a conventional first dielectric layer. As priming electrode 15 is baked and thermally deformed, first dielectric layer 17 also softens. This has often generated bubbles in first dielectric layer 17 under priming electrode 15. However, the manufacturing process of the first exemplary embodiment of the present invention can protect first dielectric layer 17 from deterioration or deformation during the baking process of priming electrode 15, eliminating a cause of dielectric breakdown. As a result, a PDP with high reliability in operation can be provided.

Steps 8 and 9 are for forming second dielectric layer 18. Second dielectric layer 18 is formed in the same manner as first dielectric layer 17 formed in steps 4 and 5. The composition of second dielectric layer 18 differs from that second dielectric layer 18 differs from that of first dielectric layer 17 in having approx. 5 wt %-increased PbO content. The softening temperature of second dielectric layer 18 is determined at 560° C., which is a 20° C.-lowered setting than the softening temperature of first dielectric layer 17. In step 8, the paste prepared for second dielectric layer 18 is applied on first dielectric layer 17 so as to cover priming electrode 15 by screen printing, or other methods described earlier. In step 9, the paste is baked at 565° C. to complete second dielectric layer 18. The baking temperature at this time (565° C.) is determined so as to be lower than the softening temperatures of the materials forming priming electrode 15 (570° C.); first dielectric layer 17 (580° C.); and data electrode 10 (590° C.), and so as to be higher than the softening temperature of the material forming second dielectric layer 18. Therefore the temperature setting can protect priming electrode 15, first dielectric layer 17, and data electrode 10 from deterioration or deformation during the baking process of second dielectric layer 18, eliminating a cause of dielectric breakdown on priming electrode 15.

Steps 10 and 11 are for forming barrier rib 11 and phosphor layers 14. In step 10, photosensitive paste including a glass component and a photosensitive organic component is applied on second dielectric layer 18 and then dried. Through a photo process, patterns of vertical wall 11*a* and horizontal wall 11*b*, which form the space between main discharge cells 12, the space between priming discharge cells 16, and gap 13, are formed. Besides, phosphor layers 14 for red (R), green (G), and blue (B) are formed by filling in main discharge cells 12. The softening temperatures of barrier rib 11 and phosphor layers 14 are 550° C. or lower. In step 11, barrier rib 11 and phosphor layers 14 are simultaneously baked at 555° C. to complete them. The baking temperature at that time is set to be lower than each softening temperature of underlying second dielectric layer 18, priming electrode 15, first dielectric layer 17, and data electrode 10. The temperature setting can protect the underlying components from deterioration or deformation during the baking process. As a further advantage, the underlying components make a foundation to support top-situated barrier rib 11. Minimizing the deformation in the underlying components can provide barrier rib 11 with consistent dimensional accuracy. As a result, a PDP with a high accuracy of dimension can be obtained.

Back substrate 2 is thus completed through the process above.

Second Exemplary Embodiment

Next will be described the second exemplary embodiment of the present invention with reference to FIG. 8.

In the first exemplary embodiment, data electrodes 10, first dielectric layer 17, priming electrodes 15, second dielectric layer 18, and barrier rib 11 are separately baked with the softening temperature of them determined in higher-to-lower order named, whereby all the components forming the back substrate are considerably protected against deterioration and deformation. Among the components above, deformation of first dielectric layer 17 seriously affects the dielectric breakdown. The following method, which focuses on protecting only first dielectric layer 17 from deformation, can simplify the manufacturing process. That is, the softening temperatures of first dielectric layer 17, priming electrode 15, second dielectric layer 18 are determined in higher-to-lower order named; the softening temperature of data electrode 10 is determined to be the same as that of first dielectric layer 17 and the two are baked at the same time; and each softening temperature of barrier rib 11 and phosphor layer 14 is determined to be the same as that of second dielectric layer 18 and the three are baked at the same time.

The second exemplary embodiment describes a manufacturing process in which data electrode 10 and first dielectric layer 17 undergo the simultaneous baking, while second dielectric layer 18, barrier rib 11, and phosphor layer 14 undergo the simultaneous baking.

Figure 8:
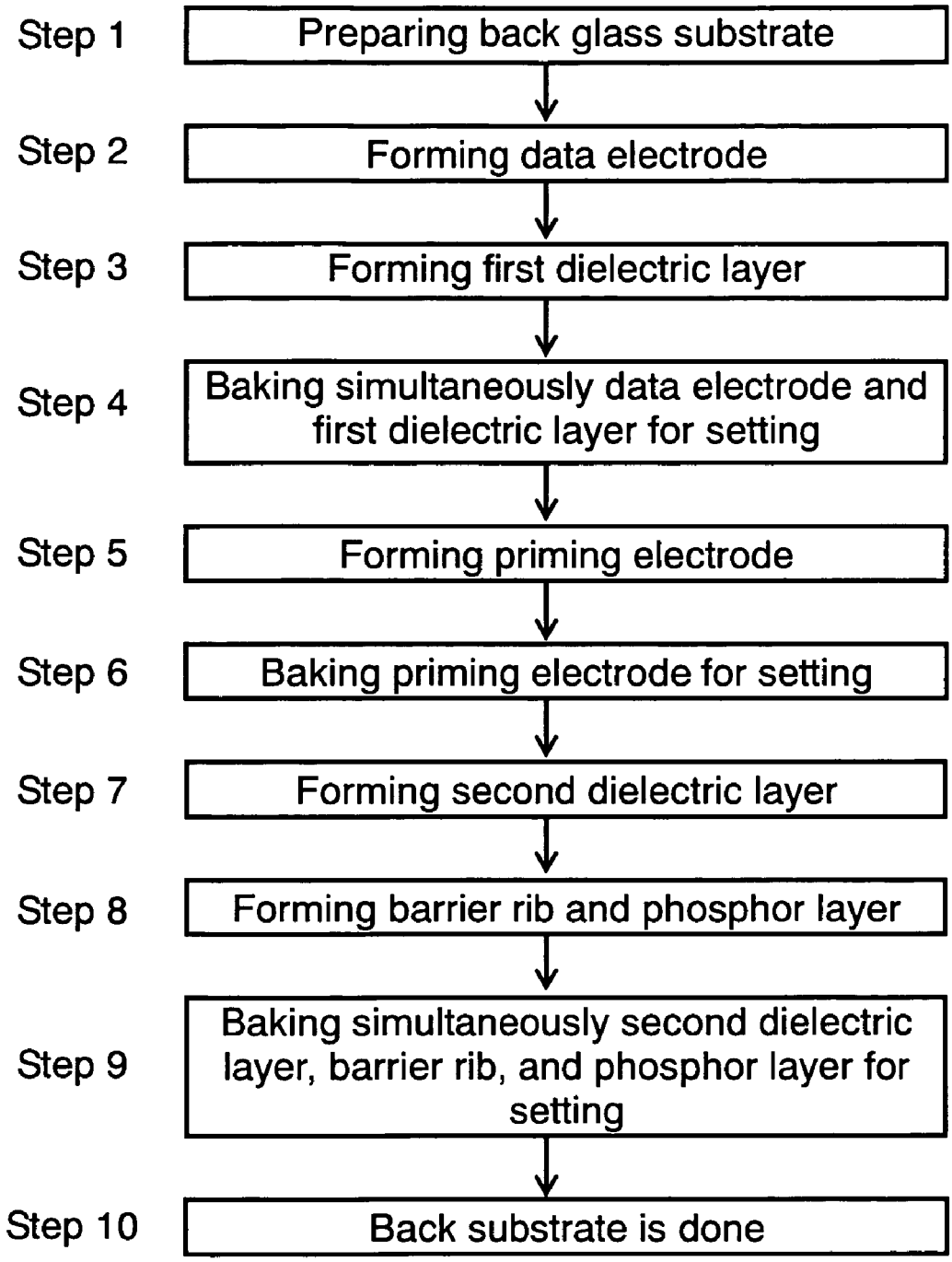
FIG. 8 is a flowchart showing a process of simultaneous baking of the back plate of the PDP of a second exemplary embodiment.

FIG. 8 is a flowchart showing a process of simultaneous baking of the back plate of the PDP of a second exemplary embodiment.

In step 1, as shown in FIG. 8, prepare the back glass-substrate as back plate 2. In step 2, apply silver (Ag) paste to the back glass-substrate and then form silver (Ag) line having a width of 150 μm by photolithography. The precursor for data electrode 10 is thus formed. Of the glass components forming data electrodes 10, at least one component has a softening temperature of 580° C.

Step 3 is for forming the precursor layer for first dielectric layer 17. As the materials of first dielectric layer 17, ZnO—$B_2O_3$—$SiO_2$-based mixture, PbO—$B_2O_3$—$SiO_2$-based mixture, PbO—$B_2O_3$—$SiO_2$—$Al_2O_3$-based mixture, PbO—ZnO—$B_2O_3$—$SiO_2$-based mixture, $Bi_2O_3$—$B_2O_3$—$SiO_2$-based mixture, or the like, can be employed. First dielectric layer 17 of the embodiment of the present invention is a mixture of 65-70 wt % PbO; 5 wt % $B_2O_3$; and 25-30 wt % $SiO_2$, having the same softening temperature as data electrode 10. The softening temperature can be flexibly determined by increasing or decreasing the PbO content. Mix the materials of first dielectric layer 17 into a paste and apply it over the precursor for data electrode 10. The applying method is not limited to a specific one; the paste can be applied or printed in a well know manner, such as roll coating, slit die coating, doctor blade method, screen printing, and off-set printing. In the second embodiment of the present invention, the applying thickness of the paste of first dielectric layer 17 should preferably range from 5 to 40 μm. Applying the paste with a thickness of 5 μm or more can lessen the unevenness of the surface of first dielectric layer 17—due to data electrodes 10 disposed thereunder—after the baking process. The applying thickness of first dielectric layer 17 depends on the mineral element content in the paste.

In step 4, the precursor for data electrode 10 and the precursor layer for first dielectric layer 17 are simultaneously baked at 585° C. Data electrode 10 and first dielectric layer 17 are thus completed.

In the next steps 5 and 6, priming electrode 15 is formed. In step 5, silver (Ag) paste is applied to first dielectric layer 17 in a manner almost the same as that for forming the precursor for data electrode 10 in step 2. Of glass components forming priming electrode 15, at least one component has a softening temperature of 570° C. In step 6, the paste is baked at 575° C. to complete priming electrode 15. The baking temperature at this time (i.e., 575° C.) is lower than the softening temperatures of the materials forming first dielectric layer 17 (580° C.) and data electrode 10 (580° C.); and is not less than the softening temperature of the materials forming priming electrode 15 (570° C.). The temperature setting can protect first dielectric layer 17 from deterioration or deformation during the baking process of priming electrode 15, eliminating a cause of dielectric breakdown on priming electrode 15. As a result, a PDP with high reliability in operation can be provided.

Step 7 is for forming the precursor layer for second dielectric layer 18. Second dielectric layer 18 is formed in the same manner as first dielectric layer 17 formed in steps 3. To form the precursor layer for second dielectric layer 18, paste is applied on first dielectric layer 17 so as to cover priming electrode 15 by screen printing, or other methods described earlier. The composition of second dielectric layer 18 differs from that of first dielectric layer 17 in having approx. 5 wt %-increased PbO content. The softening temperature of second dielectric layer 18 is determined at 560° C. or lower, which is a 20° C.-lowered setting than the softening temperature of first dielectric layer 17.

Step 8 is for forming barrier rib 11 and the precursor layer for phosphor layer 14. First, photosensitive paste including a glass component and a photosensitive organic component is applied on second dielectric layer 18 and then dried. Through a photo process, patterns of vertical wall 11*a* and horizontal wall 11*b*, which form the space between main discharge cells 12, the space between priming discharge cells 16, and gap 13, are formed. Besides, phosphor layers 14 for red (R), green (G), and blue (B) are formed by filling in main discharge cells 12. The softening temperatures of barrier rib 11 and phosphor layers 14 are determined to be the same as that of second dielectric layer 18.

In step 9, the precursor layer for second dielectric layer 18, barrier rib 11, and the precursor layer for phosphor layer 14 are simultaneously baked at 565° C. to complete them. Second dielectric layer 18, barrier rib 11, and phosphor layer 14 are thus completed. The baking temperature at that time (565° C.) is lower not only than the softening temperature of the materials forming priming electrode 15 (570° C.) but also than the lower softening temperature of the materials forming first dielectric layer 17 and data electrode 10, and is not less than the highest softening temperature of the materials for second dielectric layer 18, barrier rib 11, and phosphor layer 14. The temperature setting can protect priming electrode 15, first dielectric layer 17, and data electrode 10 from deterioration or deformation during the baking process. As a further advantage, the aforementioned components make a foundation to support top-situated barrier rib 11. Minimizing the deformation in the components can provide barrier rib 11 with consistent dimensional accuracy. As a result, a PDP with a high accuracy of dimension can be obtained.

As described above, data electrode 10 and first dielectric layer 17 are simultaneously baked; on the other hand, second dielectric layer 18, barrier rib 11, and phosphor layer 14 are simultaneously baked. Introducing the simultaneous baking can simplify the manufacturing steps of back plate 2.

Moreover, priming electrode 15, second dielectric layer 18, barrier rib 11, and phosphor layer 14 can be simultaneously baked. This can further simplify the manufacturing process.

Figure 9:
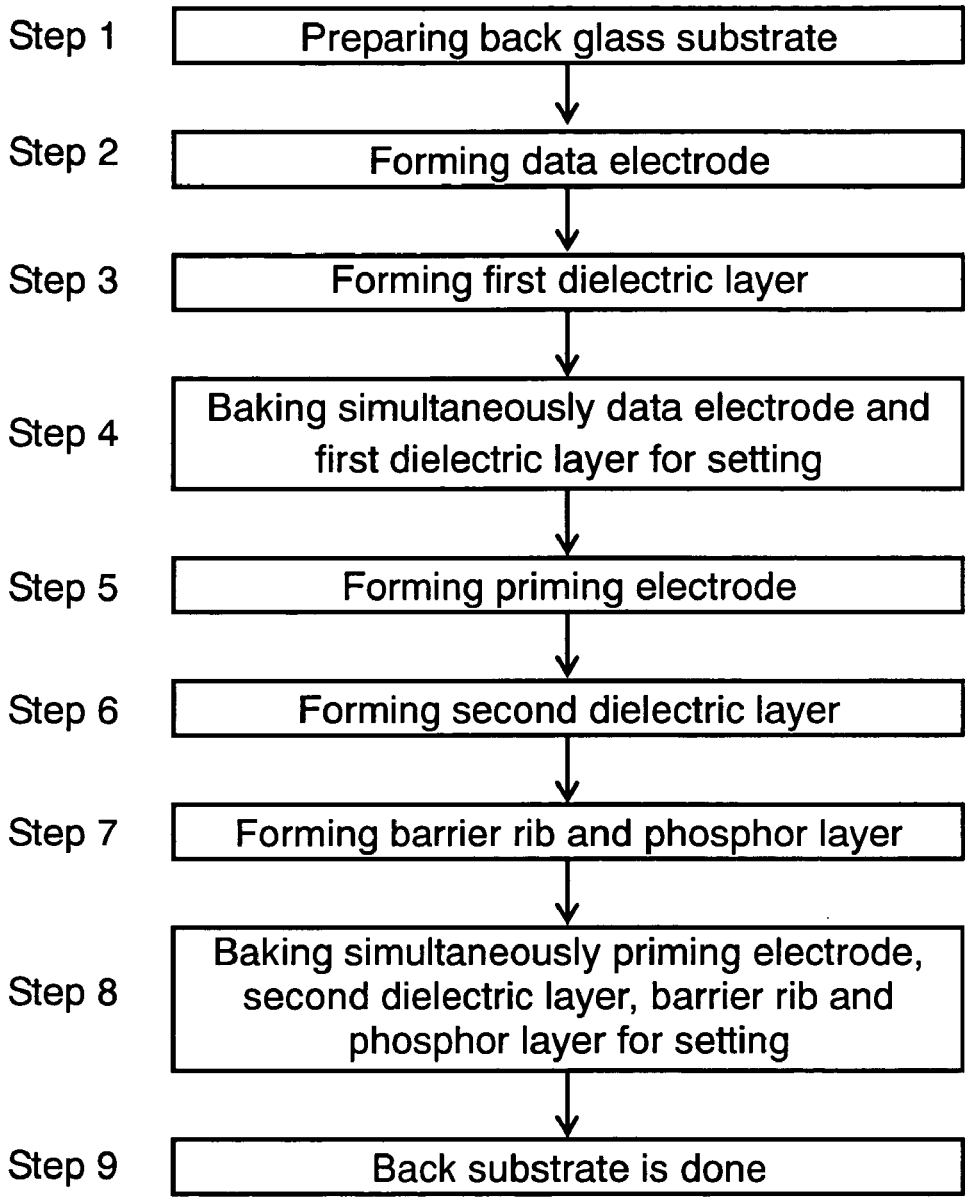
FIG. 9 is a flowchart showing another process of simultaneous baking of the back plate of the PDP.

FIG. 9 is a flowchart showing another process of simultaneous baking of the back plate of the PDP of the embodiment of the present invention. The processes of step 1 through step 4 of FIG. 9 are the exactly alike to those of the process in FIG. 8.

Step 5 is for forming the precursor for priming electrode 15. Of glass components forming priming electrode 15, at least one component has a softening temperature of 560° C.

Step 6 is for forming the precursor layer for second dielectric layer 18. Here in the description, the softening temperature of second dielectric layer 18 is determined to be the same as that of priming electrode 15.

Step 7 is for forming barrier rib 11 and the precursor layer for phosphor layer 14. The softening temperature of barrier rib 11 and phosphor layer 14 are also determined to be the same as that of priming electrode 15.

Step 8 is for forming priming electrode 15, second dielectric layer 18, barrier rib 11, and phosphor layer 14. In this step, the precursor for priming electrode 15, the precursor layer for second dielectric layer 18, barrier rib 11, and the precursor layer for phosphor layer 14 are simultaneously baked at 565° C.

The baking temperature at that time (565° C.) is lower than the lower softening temperature (580° C.) of the materials forming data electrode 10 and first dielectric layer 17, and is not less than the highest softening temperature (560° C.) of the materials for priming electrode 15, second dielectric layer 18, barrier rib 11, and phosphor layer 14. The temperature setting can protect first dielectric layer 17 from deterioration or deformation during the baking process.

Baking priming electrode 15 together with second dielectric layer 18 and the components above can further simplify the manufacturing process. These components are baked at a temperature lower than the softening temperature of first dielectric layer 17. This protects first dielectric layer 17 from deterioration or deformation during the baking process, eliminating a cause of dielectric breakdown on priming electrode 15. As a result, a PDP with high reliability in operation can be provided.

Although lead (Pb)-based mixture is used for the material of first dielectric layer 17 and second dielectric layer 18 in the description, zinc (Zn)-, or bismuth (Bi)-based mixture can be employed for them. In this case, the softening temperature of the material can be flexibly determined by increasing or decreasing the Zn or Bi content.

The wording of the "same" softening temperature used through the description means substantially the same temperature. Therefore, a difference between the materials that are baked at the same time is negligible in the scope that the purpose of the present invention can be realized as is intended.

INDUSTRIAL APPLICABILITY

The PDP of the present invention contains, as described above, priming discharge cells responsible for priming discharge between the front plate and the back plate. The discharge distance of a priming discharge cell is smaller than that of a main discharge cell, allowing the priming discharge cell to have the priming discharge with reliability prior to main discharge (i.e., address discharge). As a further advantage, keeping a proper dielectric voltage between the data electrode and the priming electrode can improve reliable operations of a PDP.

The invention claimed is:

1. A plasma display panel comprising:

a first electrode and a second electrode disposed on a first substrate so as to be parallel with each other;

a third electrode disposed on a second substrate confronting the first substrate via a discharge space so as to be orthogonal to the first electrode and the second electrode;

a fourth electrode disposed on the second substrate so as to be parallel with the first electrode and the second electrode and to be positioned closer to the first electrode and the second electrode than the third electrode; and a barrier rib disposed on the second substrate to separate a plurality of main discharge cells, which are formed of the first electrode, the second electrode, and the third electrode, from a plurality of priming discharge cells, which are formed of the first electrode and the fourth electrode or formed of the second electrode and the fourth electrode, wherein, at least the third electrode is covered with a first dielectric layer and the fourth electrode is disposed on the first dielectric layer, and the fourth electrode is made of material having a softening temperature lower than that of material forming the first dielectric layer.

2. The plasma display panel of claim 1, wherein the fourth electrode is covered with a second dielectric layer, and material forming the second dielectric layer has a softening temperature not greater than that of material forming the fourth electrode.

3. The plasma display panel of claim 1, wherein material forming the first dielectric layer has a softening temperature not greater than that of material forming the third electrode.

4. The plasma display panel of claim 2, wherein the barrier rib is disposed on the second dielectric layer, and material forming the barrier rib has a softening temperature not greater than that of material forming the second dielectric layer.

5. A method of manufacturing a plasma display panel comprising:

forming a first electrode and a second electrode on a first substrate so as to be parallel with each other;

forming a third electrode on a second substrate confronting the first substrate via a discharge space so as to be orthogonal to the first electrode and the second electrode;

forming a first dielectric layer to cover the third electrode;

forming a fourth electrode on the first dielectric layer so as to be parallel with the first electrode and the second electrode and to be positioned closer to the first electrode and the second electrode than the third electrode;

forming a second dielectric layer to cover the fourth electrode; and forming a barrier rib on the second substrate to separate a plurality of main discharge cells, which are formed of the first electrode, the second electrode, and the third electrode, from a plurality of priming discharge cells, which are formed of the first electrode and the fourth electrode or formed of the second electrode and the fourth electrode, wherein, at least each of the forming of the first dielectric layer, the forming of the fourth electrode, and the forming of the second dielectric layer includes baking respective paste material for setting, a baking temperature of the baking the fourth electrode is determined to be lower than a softening temperature of material forming the first dielectric layer and to be higher than a softening temperature of material forming the fourth electrode, and a baking temperature of the baking of the second dielectric layer is determined to be lower than the softening temperature of material forming the fourth electrode and to be higher than a softening temperature of material forming the second dielectric layer.

6. The method of manufacturing a plasma display panel of claim 5 further includes pattern-forming the barrier rib on the second dielectric layer and baking the barrier rib for setting, and a baking temperature of the baking of the barrier rib is not greater than the softening temperature of material forming the second dielectric layer.

7. A method of manufacturing a plasma display panel comprising:

forming a first electrode and a second electrode on a first substrate so as to be parallel with each other;

forming a third electrode on a second substrate confronting the first substrate via a discharge space so as to be orthogonal to the first electrode and the second electrode;

forming a first dielectric layer to cover the third electrode;

forming a fourth electrode on the first dielectric layer so as to be parallel with the first electrode and the second electrode and to be positioned closer to the first electrode and the second electrode than the third electrode;

forming a second dielectric layer to cover the fourth electrode; and forming a barrier rib on the second substrate to separate a plurality of main discharge cells, which are formed of the first electrode, the second electrode, and the third electrode, from a plurality of priming discharge cells, which are formed of the first electrode and the fourth electrode or formed of the second electrode and the fourth electrode, wherein, at least each of the forming of the third electrode, the forming of the first dielectric layer, the forming of the fourth electrode, the forming of the second dielectric layer, and the forming of the barrier rib includes baking respective paste material for setting;

after the baking of the third electrode and the baking of the first dielectric layer are simultaneously performed, the baking of the fourth electrode follows, and then the baking of the second dielectric layer and the baking of the barrier rib are simultaneously performed;

a baking temperature of the baking of the fourth electrode is lower than the materials forming the third electrode and the first dielectric layer, and is not less than a softening temperature of material forming the fourth electrode;

and a baking temperature of the baking of the second dielectric layer and the barrier rib is lower than the softening temperature of material forming the fourth electrode, and is not less than a softening temperature of a material having the highest softening temperature of materials forming the second dielectric layer and the barrier rib.

8. A method of manufacturing a plasma display panel comprising:

forming a first electrode and a second electrode on a first substrate so as to be parallel with each other;

forming a third electrode on a second substrate confronting the first substrate via a discharge space so as to be orthogonal to the first electrode and the second electrode;

forming a first dielectric layer to cover the third electrode;

forming a fourth electrode on the first dielectric layer so as to be parallel with the first electrode and the second electrode and to be positioned closer to the first electrode and the second electrode than the third electrode;

forming a second dielectric layer to cover the fourth electrode; and forming a barrier rib on the second substrate to separate a plurality of main discharge cells, which are formed of the first electrode, the second electrode, and the third electrode, from a plurality of priming discharge cells, which are formed of the first electrode and the fourth electrode or formed of the second electrode and the fourth electrode, wherein, at least each of the forming of the third electrode, the forming of the first dielectric layer, the forming of the fourth electrode, the forming of the second dielectric layer, and the forming of the barrier rib includes baking respective paste material for setting;

after the baking of the third electrode and the baking of the first dielectric layer are simultaneously performed, the baking of the fourth electrode, the baking of the second dielectric layer, and the baking of the barrier rib are simultaneously performed;

a baking temperature of the baking of the fourth electrode, the second dielectric layer, and the barrier rib is lower than materials forming the third electrode and the first dielectric layer, and is not less than a softening temperature of a material having the highest softening temperature of materials forming the fourth electrode, the second dielectric layer, and the barrier rib.

* * * * *